US009849951B2

(12) United States Patent
Angelini et al.

(10) Patent No.: US 9,849,951 B2
(45) Date of Patent: Dec. 26, 2017

(54) DIVING BUOYANCY COMPENSATOR JACKET

(71) Applicants: Sergio Angelini, Lavagna (IT); Chiara Pareti, Santo Stefano d'Aveto (IT); Enrico Oneto, Rapallo (IT)

(72) Inventors: Sergio Angelini, Lavagna (IT); Chiara Pareti, Santo Stefano d'Aveto (IT); Enrico Oneto, Rapallo (IT)

(73) Assignee: Mares S.p.A., Rapallo (GE) (IT)

( * ) Notice: Subject to any disclaimer, the term of this patent is extended or adjusted under 35 U.S.C. 154(b) by 0 days.

(21) Appl. No.: 15/361,158

(22) Filed: Nov. 25, 2016

(65) Prior Publication Data

US 2017/0152010 A1 Jun. 1, 2017

(30) Foreign Application Priority Data

Nov. 30, 2015 (IT) ..... 102015000078506

(51) Int. Cl.

| | |
|---|---|
| ***B63C 11/08*** | (2006.01) |
| ***A41D 13/012*** | (2006.01) |
| ***A41F 15/00*** | (2006.01) |
| ***A41F 9/00*** | (2006.01) |

(52) U.S. Cl.

CPC ..... *B63C 11/08* (2013.01); *A41D 13/0125* (2013.01); *A41F 9/002* (2013.01); *A41F 15/002* (2013.01); *B63C 2011/085* (2013.01)

(58) Field of Classification Search

CPC ..... B63C 11/08; B63C 2011/085; A41D 13/0125; A41F 9/002; A41F 15/002

USPC ..... 405/186; 441/106, 108, 111–119

See application file for complete search history.

(56) References Cited

U.S. PATENT DOCUMENTS

| | | | | | |
|---|---|---|---|---|---|
| 3,105,359 | A | * | 10/1963 | Ellis | B63C 11/08 224/934 |
| 3,135,098 | A | * | 6/1964 | Root | B63C 11/08 128/205.22 |
| 4,123,814 | A | * | 11/1978 | Ettinger | B63C 9/115 441/111 |
| 4,194,257 | A | * | 3/1980 | Martin | B63C 9/11 182/3 |
| 4,778,307 | A | * | 10/1988 | Faulconer | B63C 11/08 24/197 |
| 4,887,932 | A | * | 12/1989 | Toth | B63C 11/30 405/186 |
| 5,046,894 | A | * | 9/1991 | Bergstrom | B63C 11/30 405/186 |

(Continued)

FOREIGN PATENT DOCUMENTS

| | | | | | |
|---|---|---|---|---|---|
| EP | 0760337 | A1 | * | 3/1997 | B63C 11/08 |
| JP | 2000043789 | A | * | 2/2000 | B63C 11/08 |
| WO | 2009135874 | | | 11/2009 | |

*Primary Examiner* — Frederick L Lagman

(74) *Attorney, Agent, or Firm* — Themis Law

(57) ABSTRACT

A buoyancy compensator jacket for scuba diving includes an inflatable and deflatable bladder; a backplate part, to which the bladder and elements fastening at least one breathing gas cylinder are attached; and at least one pair of shoulder straps for securing it to the torso of a user and at least one ventral securing strap or ventral closure of the jacket. The jacket further includes a sternal securing element composed of at least one sternal or chest strap, which has at least one costal connection element distinct from the pair of shoulder straps and connecting the sternal strap to the backplate part.

19 Claims, 9 Drawing Sheets

(56) References Cited

U.S. PATENT DOCUMENTS

| | | | | | |
|---|---|---|---|---|---|
| 5,074,714 | A * | 12/1991 | Franco | B63C 11/30 | 114/315 |
| 5,249,890 | A * | 10/1993 | Bergstrom | B63C 11/02 | 405/185 |
| 5,295,765 | A * | 3/1994 | Choi | B63C 11/08 | 405/186 |
| 5,378,084 | A * | 1/1995 | Walters | B63C 11/08 | 405/186 |
| 5,516,234 | A * | 5/1996 | Duchesne | B63C 11/08 | 2/102 |
| 5,607,258 | A | 3/1997 | Eungard | | |
| 5,662,433 | A * | 9/1997 | Seligman | A41D 13/0125 | 114/315 |
| 5,860,769 | A * | 1/1999 | Seligman | A44B 11/263 | 224/264 |
| 5,902,073 | A | 5/1999 | Eungard | | |
| 6,120,213 | A * | 9/2000 | Stinton | B63C 11/08 | 405/186 |
| 6,659,689 | B1 * | 12/2003 | Courtney | B63C 9/08 | 2/2.17 |
| 6,755,594 | B1 * | 6/2004 | Jacoway | B63C 11/30 | 405/186 |
| 6,773,318 | B1 * | 8/2004 | Albright | A41D 13/0125 | 441/118 |
| 2001/0029951 | A1 * | 10/2001 | Miklos | B63C 11/04 | 128/205.22 |
| 2002/0057946 | A1 * | 5/2002 | Beltrani | B63C 11/2245 | 405/186 |
| 2005/0074295 | A1 * | 4/2005 | Kawashima | B63C 11/30 | 405/186 |
| 2011/0305520 | A1 * | 12/2011 | West | B63C 11/30 | 405/186 |

* cited by examiner

DIVING BUOYANCY COMPENSATOR JACKET

FIELD OF THE INVENTION

The present invention relates to the field of diving equipment.

The invention is preferably and advantageously applied in the field of buoyancy compensators or stabilizers, usually known also by the acronym BD or BCD (Buoyancy Control Device) or by the term jacket.

Particularly the invention relates to a buoyancy compensator jacket as described hereinafter.

BACKGROUND OF THE INVENTION

Generally, a buoyancy compensator jacket enables the diver to take his/her position underwater at the desired depth and acts as a structure transporting one or more cylinders for an air or gas mixture.

To this end, the buoyancy compensator jacket comprises:

an airtight bladder or casing equipped with a system for connection to the body;

a system for inflating the bladder that is manually operable and usually supplied with the compressed gas of the cylinder;

a system for draining the inflation gas of the bladder, in turn comprising one or more vent valves that are manually operable and optionally one or more valves for automatically venting the gas;

a frame fastening one or more cylinders of an air or other breathing gas mixture.

Briefly, the regulation of the amount of gas contained in the bladder allows the diver's body to be positioned and stabilized in water at different depths; its operation and possible equipment are however generally known to the person skilled in the art and, therefore, no additional reference is made thereto.

The system for connecting the airtight bladder to the diver's body usually comprises a backplate, generally rigid, and a harness, in turn having shoulder strap elements, and a ventral belt or strap (or securing strap) at the waist with removable closure elements, such as buckles or the like.

The cylinder in turn is connected to the backplate by one or more belts or the like.

More in details, a known embodiment (possibly one of the most conventional ones) of a buoyancy compensator jacket includes a vest or waistcoat that houses or forms the inflatable bladder or casing. The jacket is worn and secured on the user's torso by a pair of shoulder straps or strips and has at least one ventral belt or strap (or securing strap) at the waist.

The backplate can be fastened to the back region of the jacket in different manners.

The ventral belt or strap can be fastened to the jacket or preferably to the backplate.

Therefore, while in the ventral region there is a substantially direct coupling between the backplate, to which the cylinder is connected and the ventral belt or strap element, thereby the backplate and so the cylinder are firmly held against the diver's body, in the upper part of the backplate, with reference to the upright position of the user, the connection of the backplate with the diver's body is indirect since it occurs through shoulder straps that support the weight thereof with the jacket in the worn condition, as the shoulder straps are an extension of the bladder, and the bladder, as a waistcoat, being connected to the backplate; it has to be noted—parenthetically—that also the ventral strap or belt can be connected to the bladder and not directly to the backplate.

At most in the sternal region of the user it is possible to provide a brace that removably connects the shoulder straps with each other and that prevents them from progressively opening wide. Such brace however does not give any effect for fastening the backplate to the user body in the area of the sternal strap or chest of the user.

Such configuration of the jacket has some limits particularly as regards a firm fastening of the cylinder to the body, that is to the back of the user. When the user transports the cylinder in water and above all on ground, the cylinder that is the most heavy element of the assembly and therefore affecting his/her stability, is coupled by the backplate in an indirect manner to the top part of the diver's body (through the shoulder straps, that are an extension of the inflatable bladder) and therefore a certain degree of relative movement is possible between the cylinder and the diver in the form of a kind of lateral displacement or lateral swinging. Such effect is found both in jackets as the one described above and in jackets where the shoulder straps, and the waist securing strap or belt, are directly coupled to the backplate.

Moreover the shoulder straps are not particularly comfortable for the diver, since the weight and the movement of the cylinder, when getting dressed or when diving, create a certain compression and a certain friction, particularly at the shoulders and the chest, where the weight of the cylinder is discharged on the diver's body.

The conceivable consequences of the possible relative movements between the backplate and the diver are not limited to discomforts for the user—that with no wet suit can cause even injuries—but are extended also to possible early deteriorations or damages of the wet suit and/or of the jacket.

Such drawback is more present if the diver is a woman: in this case the pressure on the chest is exerted on the immediate vicinity of the breast, a particularly sensitive and delicate area.

Jackets for women are known in prior art that provide arrangements to improve wearability. In the case of the patent n. U.S. Pat. No. 5,662,433 it describes a jacket with improved wearability above all suitable for women, wherein each shoulder strap element is connected to the ventral belt or strap by a triangular shaped element, composed of a framework made of a more resistant material that surrounds a central portion made of elastic material.

This pair of triangular shaped elements, in combination with the shoulder straps and the ventral strap should allow the weight to be better distributed on shoulders, waist and hips of the diver, limiting the discomfort caused by buckles and by belts at the breast.

Although generally it is functional, however such solution has some limits.

Firstly, the triangular shaped elements are part of the structure of the shoulder strap and connect it to the ventral part, therefore the shoulder straps are also involved in supporting the weight of the cylinder and transmit a tensile force through the jacket and the triangular shaped elements, from the backplate to the ventral strap or belt; it results that inevitably the triangular shaped elements exert a certain effect pressing the chest that is perceptible by the diver, even if at a less extent than conventional jackets.

Moreover the solution with the triangular shaped elements connected to the shoulder straps does not result in a better fastening of the backplate to the sternal part of the user compared to that provided by the shoulder straps.

Another known solution, for some aspects similar, is disclosed in the patent U.S. Pat. No. 5,902,073 showing a jacket with a vest that can be divided into two parts, left and right, each one fastenable to the respective shoulder strap.

The limits of such solution, within such sphere, are substantially equal to the ones described above and therefore no further reference is made thereto.

SUMMARY OF THE INVENTION

It is the object of the present invention to overcome prior art drawbacks.

Particularly it is an object of the present invention to provide a diving jacket that can improve and make more safe the transport of the cylinder or cylinders, underwater and on the ground, while giving a better stability to the connection of said jacket (and so of the cylinder or cylinders) to the diver's body.

Another object of the present invention is to provide a jacket able to protect the chest and able to anatomically adapt itself, while keeping its shape regardless of efforts and deformations the jacket part intended to support the weight of the cylinder is subjected to.

It is also an object of the present invention to provide a buoyancy compensator jacket that is, when worn by the diver when diving, firmly placed on the diver's back.

It is a further object of the present invention to provide a jacket that can suit different bodies without the need of providing a high number of sizes, thus reducing production costs.

These and other objects of the present invention are achieved by a buoyancy compensator jacket (BCD) or stabilizer comprising a vest element embodying the characteristics of the annexed claims, which are an integral part of the present description.

The idea at the base of the present invention provides to introduce a sternal or chest element securing the backplate to the user's body that comprises a sternal or chest strap covering a part of the diver's chest and two costal or under-shoulder end connection elements distinct from the pair of shoulder straps and that connect said chest strap to the backplate part, directly or through the jacket.

Thus the jacket is added with an element for the direct connection between the backplate, to which the cylinder is connected, and the diver's torso that eliminates—or limits anyway—the relative movement between cylinder and body.

By the present invention the backplate is secured or securable to the torso of the diver's body both at his/her lower region (with reference to an upright position of the user wearing the jacket) that is the ventral region by means of the belt, and at an upper area of the backplate substantially coinciding with a sternal or chest region by means of the sternal or chest strap.

Therefore the backplate is secured to the body in two areas axially spaced apart from each other, with reference to the longitudinal axis of the backplate and therefore the lateral displacement and swinging movements that the cylinder can perform with prior art jackets are avoided.

Moreover load stresses of the cylinder are discharged on the whole torso and not only on the ventral part.

Such advantages are expressed both in jackets providing an indirect connection between the backplate and the shoulder straps (that is jackets made with an inflatable bladder like a waistcoat or vest wherein the shoulder straps are an upper extension of the bladder) and in jackets where the shoulder straps are directly connected to the backplate.

Therefore the object of the invention is a diving buoyancy compensator jacket comprising:

an inflatable and deflatable bladder 1 and a backplate part to which the bladder and the elements fastening at least one breathing gas cylinder are attached;

the jacket being provided with at least one pair of shoulder straps for securing it to the torso of a user and at least one ventral securing strap or ventral closure of the jacket, and wherein the jacket further comprises one sternal or chest securing element in turn composed of at least one sternal or chest strap and which strap has at least one costal connection element distinct from the pair of shoulder straps which element or elements connect said chest strap to the backplate part, directly or indirectly through a part of the jacket itself.

Another object of the invention is a sternal closure element for a buoyancy compensator jacket according to the last annexed claim.

In the present invention, the shoulder straps pass above the diver's shoulders to discharge the weight of the cylinder, while the costal connection elements pass under the axillary cavity at the ribs of the diver and they limit the lateral displacement and/or swinging movement of the cylinder, that result in rotating the jacket with respect to the user's body.

Preferably each costal connection element is coupled to the backplate part in an area not coinciding with the area from where said at least one pair of shoulder straps extend.

According to a first embodiment, the at least one costal connection element is not connected with and it does not form a part of the shoulder strap.

This solution, unlike prior art, provides the advantage that the sternal or chest securing element substantially acts for considerably increasing the stability of the connection between the cylinder and the diver's body, generating a further area fastening the backplate to the top part of the torso, therefore limiting the swinging and displacement movements of the cylinder and therefore movements of rotation about the jacket torso.

According to a variant embodiment the securing element can be further shaped such to exert further functions particularly as regards the protection of the user's body and the user's comfort.

According to another advantageous characteristic the sternal or chest securing elements can be length adjustable to suit the dimensions of the user's torso.

Still according to a preferred variant embodiment, the sternal or chest securing element is made of two portions separated from each other and fastenable with each other at the chest area or thorax area of the user.

Thus it is possible to obtain a jacket wherein the vertical movements are restrictable by suitably adjusting the shoulder straps (when possible) and the rotational movements of the jacket, that is of the backplate and therefore of the cylinder, are restrictable by suitably adjusting the costal connection elements.

According to a further variant, particularly suitable for the use in jackets for women, the sternal or chest securing element is fastened or fastenable both to the backplate part (by the costal connection elements) and, by means of two upper extensions, to a corresponding shoulder strap, said upper extensions being different from the sternal elements for the connection to the backplate.

Thus the sternal strap becomes a kind of bra having both a sternal securing strap connected to the backplate, preferably directly, and a shoulder strip supporting the sternal strap upwardly (with reference to an upright position of the user).

According to a further characteristic that can be provided as an alternative or in combination with the preceding one, the sternal or chest securing element is fastened or fastenable both to the backplate part (by the costal connection elements) and, along the lower edge, to the corresponding part of the ventral or waist securing belt: this allows a sternal or chest securing element like a vest to be provided that, with the belt in the closed condition at the level of the abdomen, overlaps the corresponding part of the user chest.

A preferred embodiment, particularly for the jacket suited for women, provides that when the sternal or chest strap has appendages for removably connecting to the shoulder straps, said strap is free from the connection to the ventral securing belt.

Thus there is the advantage that while keeping a shape of the sternal or chest strap similar to that of conventional bras, the tensile force of the shoulder straps that are separately connected also to the ventral strap or belt, is not transmitted thereto through the sternal or chest strap and therefore a tensile action stretching the sternal strap is not exerted, which would involve a higher compression of the breast.

This effect is made more comfortable by providing to use for the sternal or chest strap an elastic material, with a predetermined tensile elongation elasticity, for example neoprene or the like.

Moreover in the version for women the sternal or chest strap can be suitably shaped in an anatomical manner with respect to the female breast.

Thus the jacket is comfortable even if worn without the wet suit while acting for protecting the chest and as a swimsuit.

Unlike the vests described in prior art therefore the sternal securing element of the present invention is not directly coupled to the shoulder straps meaning that there is no structural connection (that is functional connection for the support of the cylinder weight) between the shoulder strap and the sternal securing element, but the shoulder straps each one has a structural direct connection with the lower ventral part of the jacket or with the ventral belt, through which the weight of the cylinder is discharged, while the connection of the sternal or chest strap to the shoulder straps is only an element supporting from above said strap that works likewise, substantially for supporting the chest upwardly.

Said shoulder strip extensions can have different embodiments not shown, such as slots, strings or the like and tend to facilitate the wearing operations and to make the jacket more comfortable, but they do not allow (or only in a very limited manner) the load of the cylinders to be transferred between the shoulder straps of the jacket and the sternal securing element.

According to a preferred embodiment of said variant, one of the portions of said sternal or chest strap that is of said vest, comprises a joining flap intended to be extended at the median longitudinal band of the chest, which flap is provided with means removably coupling with the other vest portion, for example by loops and hooks (also known as "hook-and-loop" fasteners or under the trademark Velcro) or the like: thus the vest element is well positioned on the chest, and together with the back portion it offers a protection to the whole torso, besides offering stability when transporting the cylinder.

According to a further embodiment the backplate part or the corresponding part of the inner side of the jacket comprises a soft padding that covers the rigid frame at least for a part of the surface in contact with the user's back, with the jacket in the worn condition, such that the back is not in direct contact with the rigid element: in this embodiment it is possible to provide the at least one end connection element of each vest or strap portions to be connected in a fixed or removable manner also to the soft padding.

Further advantageous characteristics are the subject matter of the annexed claims, that are an integral part of the present description.

BRIEF DESCRIPTION OF THE DRAWINGS

The invention will be described below with reference to some not limiting examples, which are depicted in the enclosed drawings, which illustrate different aspects of the invention. Where appropriate, reference numerals showing like structures, components, materials and/or elements in different figures are denoted by like reference numerals.

In the enclosed figures.

DETAILED DESCRIPTION OF EMBODIMENTS OF THE INVENTION

While the invention is susceptible of various modifications and alternative constructions, two preferred embodiments will be described in details herein below.

It should be understood, however, that the invention is not limited to the specific disclosed embodiments but, on the contrary, covers all the modifications, alternative constructions and equivalents that fall within the scope of the invention.

The use of the wording "for example", "etc.", "or" denotes non-exclusive alternatives without limitation, unless otherwise noted.

The use of the wording "comprises" means "comprises, but not limited to", unless otherwise noted.

Terms such as "vertical," "horizontal," "upper," "lower", "right." and "left," with no other indication, are to be read with reference to the related operating conditions and with reference to the standard terminology in use in common speech, in which "vertical" means a direction substantially parallel to that of the vector of the force of gravity "g" and horizontal means a direction perpendicular thereto.

With reference to the FIGS. 1 to 4, a buoyancy compensator jacket according to the invention is generally denoted by numeral 100.

The BCD, or stabilizer, is a one of the pieces of diving equipment used by the diver to regulate underwater depth and to keep a constant trim, or to dive or surface at a controlled speed. The jacket 100 is also known by the abbreviation BCD (Buoyancy control device) or by the term jacket.

There are different constructional forms for these jackets that provide different solutions in regard to frames supporting the cylinder or cylinders, and the fastening thereof to a wearable element, to which at least inflatable and deflatable airtight bladders and possibly other elements are coupled serving for housing, retaining or fastening several types of tools.

The invention is described with reference to a particular common constructional type of the jacket, but it has to be intended as covering, with easily understood changes, all the different constructional forms of the jacket to which it can be applied.

Figure 1:
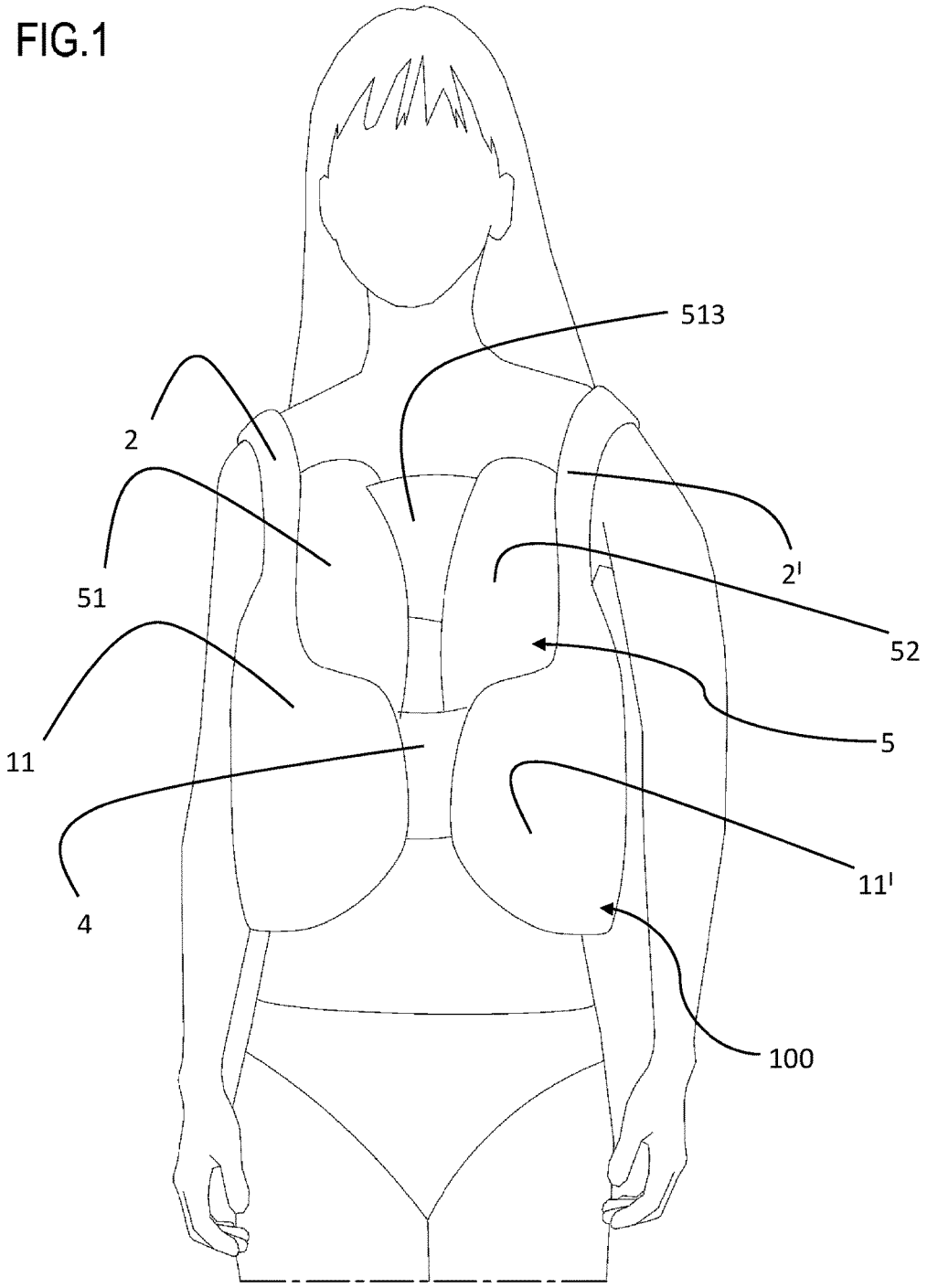
FIG. 1 is a schematic front view of a buoyancy compensator jacket according to the invention in the worn and tied condition, which is configured for use by a woman.
Figures 2, 3:
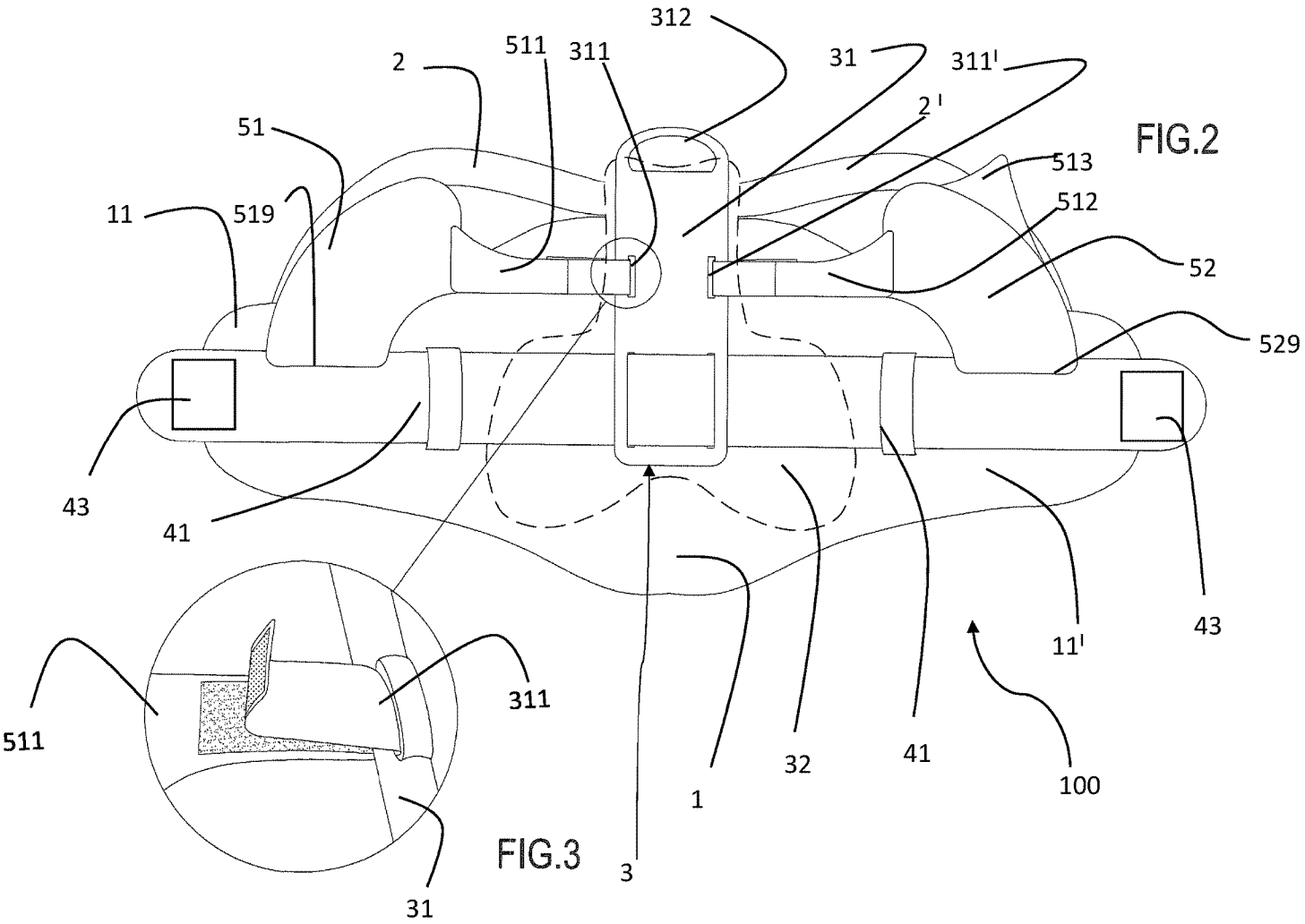
FIG. 2 is a front view of the buoyancy compensator jacket of FIG. 1, with the two vest portions disconnected from each other and the waist securing belt in the undone condition.
FIG. 3 is a detail of the buoyancy compensator jacket of to FIGS. 1 and 2, showing the right costal connection element connectable to the backplate part with a removable connection system.
Figure 4:
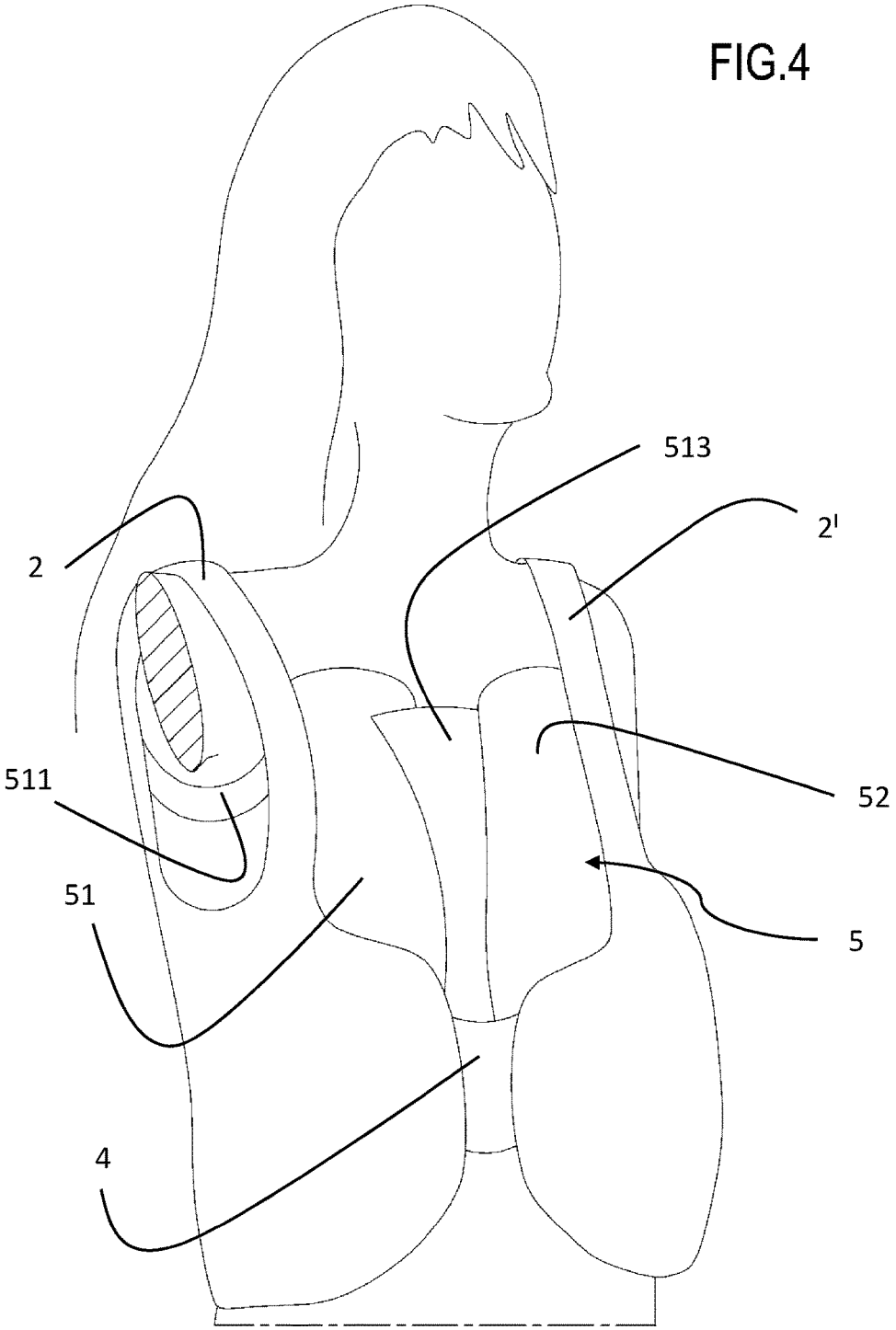
FIG. 4 is a perspective view in an intermediate direction between the sagittal and lateral direction of the jacket according to the previous figures, in the worn condition.

With reference to FIGS. 1 to 3, the jacket 100 comprises at least one deployable bladder or air cell 1, optionally covered with a protective synthetic fabric, such as nylon or the like. In embodiments not shown, there is provided a plurality (two or more) of bladders, possibly in adjustable fluid communication with each other.

The bladder 1 can be inflated or deflated generally with the gas contained in the cylinder (not shown), to which it is connected through at least one inflation valve and a vent valve for the gas or possibly other types of gas.

Valves can be operated by manual and/or automatic commands known in the art, therefore, no further reference is made thereto.

The compressed (breathing) gas cylinder is fastened in the rear part—or back—of the jacket by means of straps or belts or other system known to the skilled person.

The bladder 1 may have different configurations depending on needs]: it can extend at the back and waist of the user, or can have a horseshoe shape placed only at the back, or may have other shapes.

Then jacket 100 shown in the figures is of a conventional type, like a waistcoat or vest, with the bladder 1 placed at the back and laterally on both the sides of the diver.

The rear or wraparound bladder 1 preferably has the shape of a ring, intended to laterally wrap the cylinder, not shown, fastened in the central back area of the jacket by means of one or more straps or belts, with two inflatable/deflatable ventral expansions 11, 11' made as one piece with the rear bladder 1, such to enable the diver to comfortably and safely regulate attitude, both underwater and on the surface.

As it is clear from the figures, the jacket 100 comprises, besides the bladder 1 and coupled thereto, a backplate 3, to which fastening elements (not shown) are coupled for fastening the at least one breathing gas cylinder to the backplate 3.

The jacket 100 further comprises a pair of shoulder straps 2, 2' to secure it to the torso of the diver; to this end the shoulder straps 2,2' are directly or indirectly coupled to the backplate 3.

With reference thereto, it has to be noted that a "direct" coupling provides a connection between shoulder straps and backplate with no intermediate coupling means, while in an indirect coupling the shoulder straps are connected to the backplate by means of intermediate coupling means as in the case of a waistcoat jacket, where the intermediate coupling means is composed of the remaining part of the waistcoat, or of the bladder or of a bladder covering, connected to the backplate.

Such second coupling type is shown in the annexed figures, where the jacket is of the conventional type, wherein the shoulder straps 2,2' are an upper extension of the covering of the bladder 1, in turn connected to the backplate 3. In this case the coupling is an "indirect" coupling according to the above definition.

The shown jacket 100 then comprises optionally a waist securing strap 4 (or ventral strap or belt) also coupled directly (as defined above) to the backplate 3.

In another embodiment, not shown, the waist securing belt 4 on the contrary extends indirectly from the backplate 3, becoming an extension of the bladder 1 (or, equivalently, of its covering) or is connected to the bladder by means of loops.

The ends 41, 42 of the waist securing belt 4 are connectable with each other at the abdomen by means of removable closure elements 43.

In this non limiting example, the removable closure elements 43 are areas provided with hook-and-loop fasteners or the like, but they may be belts, buckles or other.

Figure 8:
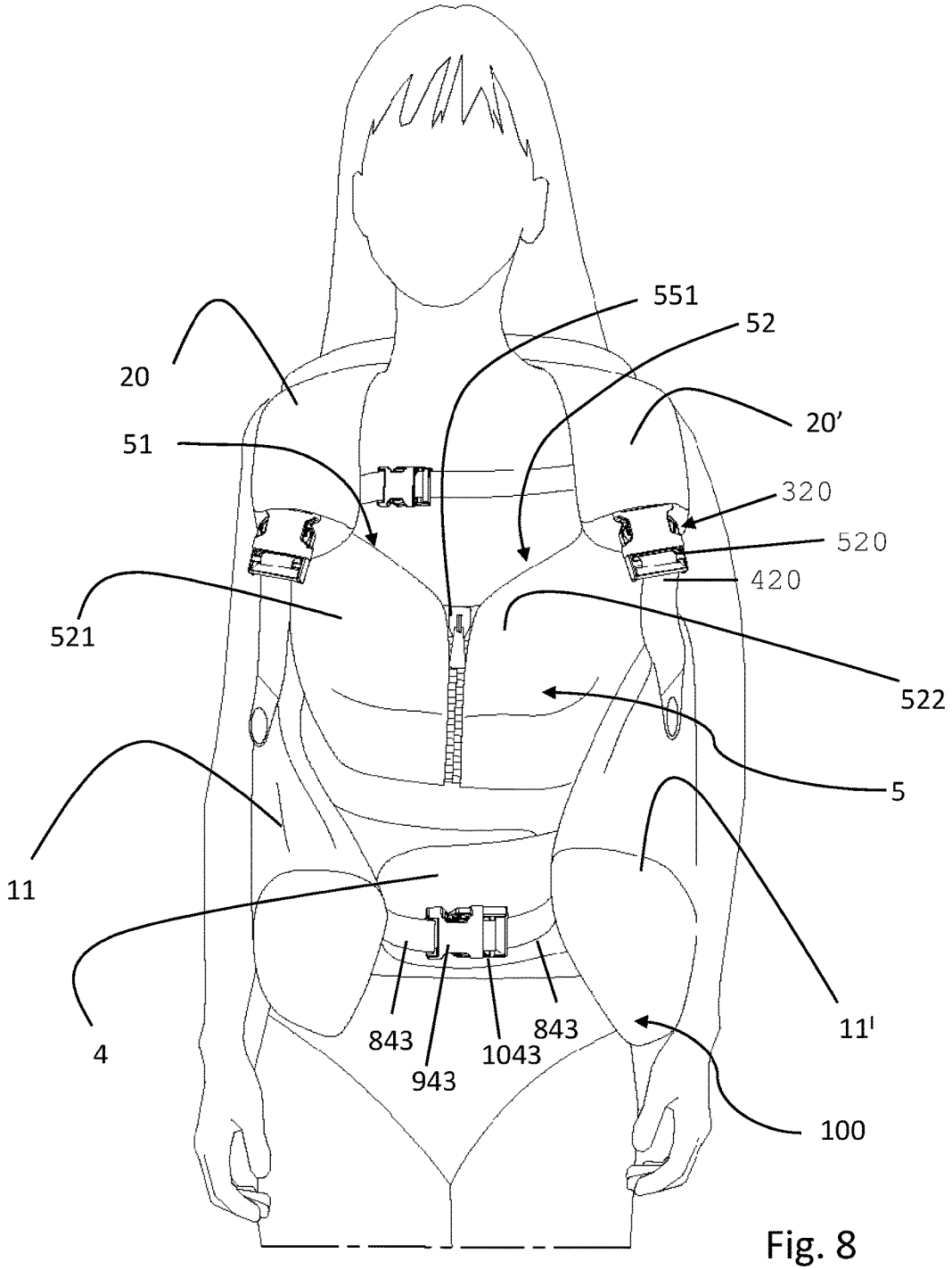
FIG. 8 is a view like FIG. 1, showing a jacket for women according to the invention in the worn condition and ready for use.
Figure 9:
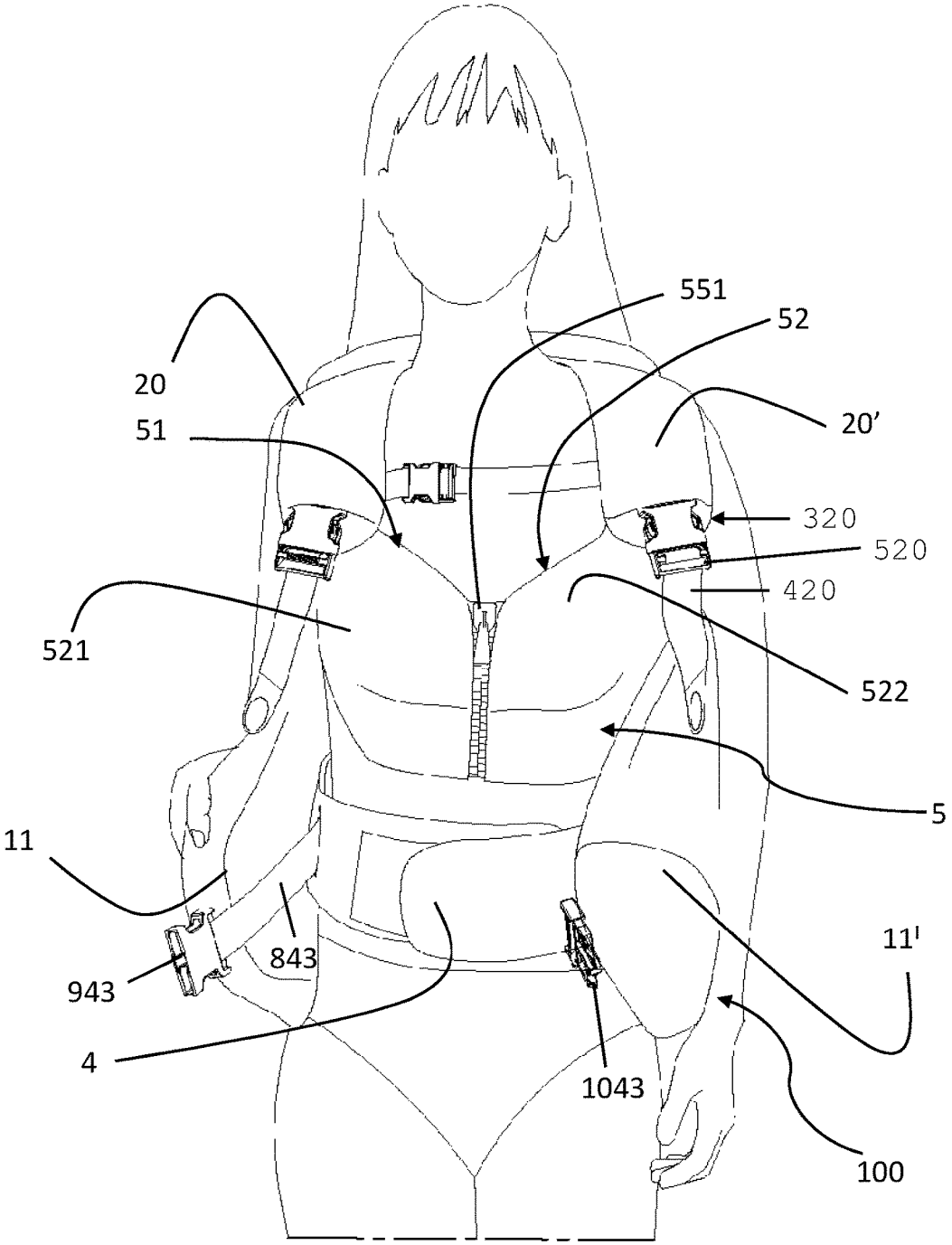
FIG. 9 is a view like FIG. 8, showing the belt of the jacket in open condition and the lower part of the jacket folded outwardly, illustrating that the vest or sternal strap is separated both from the belt, from the jacket and from the ventral strap.

In one embodiment and as shown in FIGS. 8 and 9, the two lower parts of the jacket are intended to overlap the ventral strap and contain, coincide with, or are composed of, the inflatable bladders 11, 11' and are separated from said ventral strap and associated to a connection belt denoted by 843 that holds together said two lower, ventral flaps of the jacket.

Figure 10:
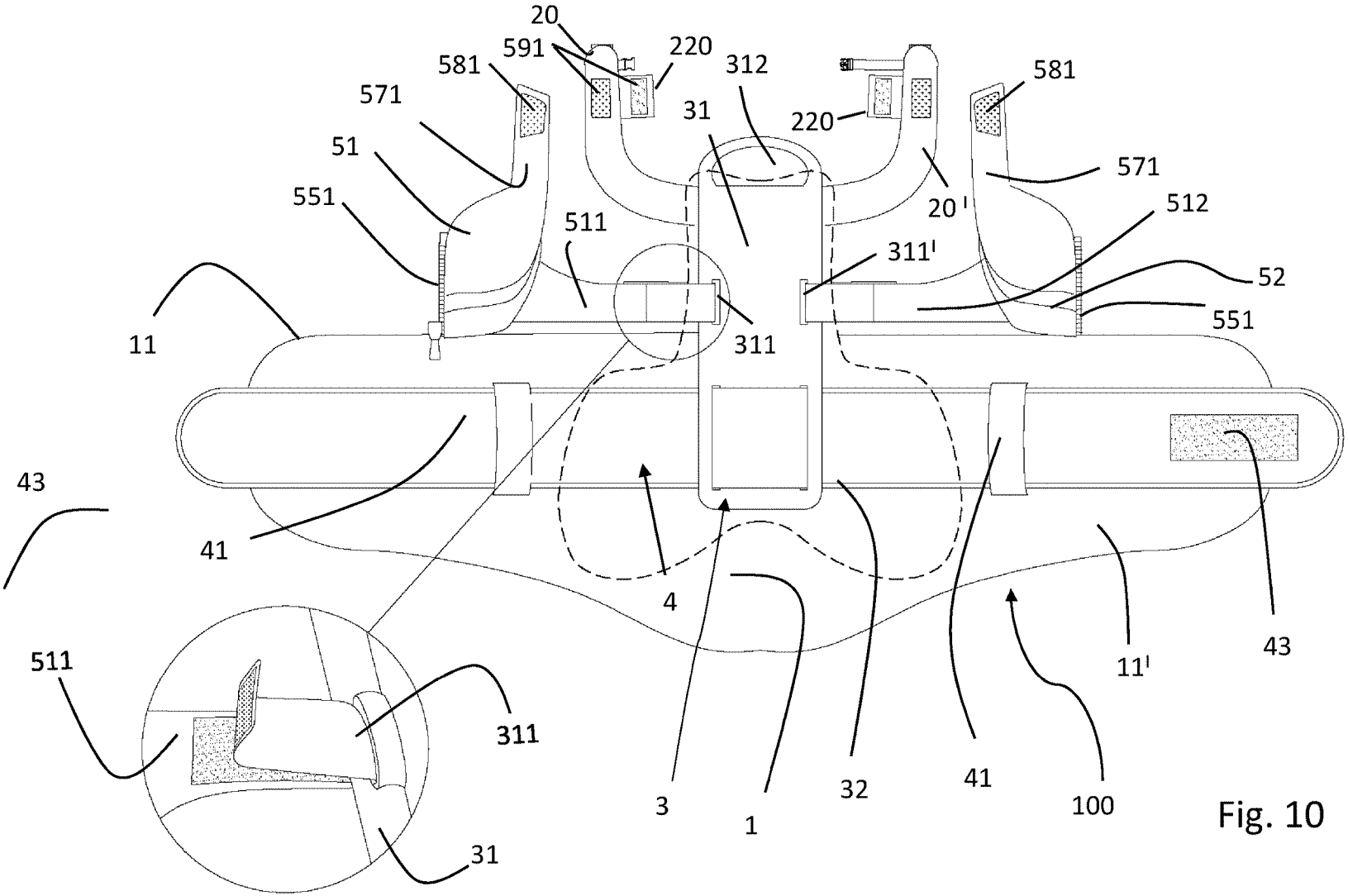
FIG. 10 is a view like FIG. 3 of the jacket according to FIGS. 8 and 9, in the open condition, with an enlarged area of the costal or under-axillary fastening element of the vest or of the sternal strap.

In this case the two parts of said belt 843 are removably connected to each other by means of an elastic snap-on fit buckle, whose parts are denoted by 943 and 1043 in FIGS. 8 to 10. Advantageously, at least one of the two parts of the buckle 943 or 1043 or both of them are connected to the corresponding part of the belt 843 such to regulate the position along said belt part with respect to the end, and, therefore, such to elongate and/or shorten the belt itself. Said means can be of any known type, for example those widely used for the adjustment of ventral straps and/or shoulder straps of backpacks or the like.

According to the invention, the jacket 100 comprises a sternal securing element, in turn comprising a vest element or sternal or chest strap 5 and two costal connection elements (or under-shoulder elements) 511, 512 distinct from the pair of shoulder straps 2, 2' and coupled to the vest element 5 and to the backplate 3.

The vest element 5 is intended to cover at least a part of the diver's chest, with the jacket in worn condition: the vest element, in such condition, is wrapped around at least the front part of the diver torso.

The vest element 5, in this example, is divided into two portions, a right portion 51 and left portion 52, connectable with each other substantially at the longitudinal median band of the chest.

In the shown example the connection between the portions 51 and 52 is removable, while in other embodiments, on the contrary, such connection is irremovable, and the vest element is as a single piece, thus its division in right/left portions is only ideal.

Still in other embodiments, even if the vest element is divided in two right and left portions, these are removably coupled (for example sewn together) thus the vest element seems like one made as a single piece.

The division of the vest element in two portions removably coupled with each other, such as shown in FIG. 1-3 however is to be preferred in order to improve wearability.

Each costal connection 511, 512 is intended to pass under the axillary hollow of the diver, in the worn condition, and for this reason it can be also called under-shoulder.

According to a particularly advantageous feature, not only the costal connection elements 511, 512 are distinct from the shoulder straps 2, 2' but are also not directly coupled (therefore disengaged) to the pair of shoulder straps 2, 2' in the above defined meaning.

Then, preferably as illustrated in FIG. 2, the costal connection element 511, 512 of each vest portion 51, 52 is connectable to the backplate 3 in a position not coinciding with that of the pair of shoulder straps 2,2'.

More in detail, costal connection elements 511, 512 are connected to the backplate part 3 in a remote position with respect to the position of connection of the shoulder straps 2, 2' such that, in the worn condition, the costal connection elements 511, 512 are about at the height of the diver axillary hollow.

In the shown embodiment, the backplate part 3 comprises a rigid frame 31 and a soft padding 32.

The rigid frame 31 is made as a plate elongated in the longitudinal direction.

The soft padding 32 covers the rigid frame 31 at least on a part of its surface facing the back of the diver, such to improve the comfort.

The padding can be provided with two side lobes resting on the user hips.

In one embodiment, the frame is provided with a shape enlarged at the lower area. Said enlarged shape coincides with the side lobes of the padding. This generates a support on the hips is generated, and achieves the effect of distributing the weight of the cylinder during the dive when in a substantially horizontal position, so the weight of the cylinder pushes from the top to the bottom.

The rigid frame 31 can be made of metal, PVC, carbon, Kevlar, Nylon, Nylon filled with glass fiber or a combination of said materials or others.

A compressed gas cylinder is fastened to the rigid frame 31 in a known manner, for example with belts or with a fastening counter-frame (not shown).

In one embodiment, on the contrary, the soft padding 32 is absent, thus it is optional for the purposes of the present invention.

Thus, the jacket 100 is worn and secured to the diver's torso by means of the pair of shoulder straps 2,2' and the waist securing strap 4, and is further fastened to the torso of the user at least at the sternal or chest area by the sternal securing element.

To this end, it has to be noted that the pair of shoulders straps 2,2' is coupled, directly or indirectly, to the rigid frame 31 at a first end portion thereof, while the waist securing belt or ventral strap 4 is coupled to the rigid frame 31 at a second end portion thereof. Said first portion is provided in the upper part or top part of the frame while said second portion is provided in the lower or bottom part of the frame with reference to the upright condition of the user wearing the jacket, such to secure the cylinder in two locations spaced from each other and that is at the top and at the bottom to the user body.

More generally in several embodiments, the pair of shoulder straps 2,2' is coupled to the backplate part 3 at a first terminal end (at the top), and the waist securing strap 4 is coupled to the backplate part 3 at a second terminal end (at the bottom). In the shown example, the costal connection elements 511, 512 are connectable to the backplate part 3 in a hooking position, on the backplate 3, extending between the first and the second end portions, however the costal elements may be connected to the backplate at the attachment of the shoulder straps, even more highly. That role is completely different from that of the shoulder straps and the position of such costal elements has to be referred mainly to the ventral closure.

Still in greater detail, in one embodiment, each shoulder strap 2,2' comprises an upper, preferably padded, portion that with the jacket in the worn condition, corresponds to the area of the shoulder, and a lower portion connected to (or integral with) one of the inflatable/deflatable ventral expansions 11, 11' of the jacket, overlapping the hip of the diver.

The waist securing strap 4 is fastened or fastenable to the backplate part 3, preferably to the frame 31 and/or to the ventral inflatable/deflatable expansions 11, 11' for closing the jacket at the front of the abdominal area of the diver.

The waist securing strap 4 generally is provided with elements 43 joining its ends such as hook-and-loop fasteners or the like, but it is also possible to provide rapid coupling/releasing buckles.

As it is noted in FIG. 2, in this non limiting embodiment, the at least one costal connection element 511, 512 of each vest portion 51, 52 is coupled to the rigid frame 31, preferably in a hooking position placed (along the extension of the frame 31) between the first and second end portions, such that the connection region of each costal connection element 511, 512 is placed, along the longitudinal extension of the frame 31, between the shoulder straps 2,2' and the belt 4, such to displace the relevant costal connection 511, 512 approximately under the axillary hollow of the diver.

It has to be noted that in other embodiments, not shown, the at least one costal connection element 511, 512 of each vest portion 51,52 is coupled, in addition to the rigid frame 31 (in a removable or fixed manner), also to the soft padding 32. Said at least one costal connection element 511, 512 thus is disconnected from the pair of shoulder straps 2,2' extending from the back portion of the jacket, at its upper edge, and there is no direct connection with each other.

As it is clear from FIGS. 2 and 3—in this example—the connection between the shoulder straps 2, 2' and the costal connection elements 511, 512 is indirect, by means of the frame 31 to which both of them are separately coupled.

The connection or coupling between the costal connection elements 511, 512 to the rigid frame 31, for example in the shown example, takes place by means of two through slots 311, 311' formed in the frame 31 that allow a free terminal end to pass for the connection of each costal connection element 511,512.

Said at least two through slots 311, 311' are preferably provided along the two longitudinal side edges of the plate forming the backplate, at the top of said plate, preferably at the user's shoulder blades.

According to a variant embodiment, instead of two costal elements separately connected to the sides of the backplate, it is also possible to provide only one costal element that passes in the backplate (like the cylinder belt) and that has two ends that can be connected with each other in the chest area. Even if the element is a single element, a length adjustment is also possible.

Advantageously, the terminal upper end of the rigid frame 31 (considering the jacket worn by the user in the upright position) is shaped like a handle 312 and is a grasping element to facilitate the transport of the jacket.

The second opposite end has two through slots wherein, in the mounted condition, and the belt 4 is fitted for connection, in this example a sliding connection, with the frame 31.

As shown in FIG. 3, the removable connection of each costal connection element 511, 512 with the rigid frame 31 can also take place by a removable mechanical coupling, of the "hook and loop" type (or Velcro) or the like. The free end of each costal connection element 511, 512 is passed into the slot 311, 311' and is folded on itself to form a slotted extension, the two mutually contacting portions of the costal connection element being coupled with each other by hook-and-loop fasteners or other known removable connection means, so that the overall length is adjustable.

By adjusting the length of the mutually coupled parts it is possible to adjust the length of the costal connection elements 511 and 512.

When a single costal element is provided, like a belt passing in the backplate and closed on itself by connecting the two ends with each other, the adjustment can take place by acting on the mutual fastening position of the two end parts of the costal element.

In alternative embodiments not shown, a connection of the fixed type is provided between the rigid frame 31 and the costal connection elements 511, 512.

The fixed connection can be accomplished in several manners within the knowledge of the person skilled in the art once knowing the present invention; for example the free end of each costal connection element 511, 512 is passed in the slot 311, 311' and is folded on itself to form a slotted extension, the two mutually contacting portions of the costal connection element being coupled to each other by seams, rivets or the like.

It is possible to have, even in the case when the costal connection elements 511 and 512 are connected in a not removably manner to the rigid frame 31, an adjustable length of the costal connection element, for example using buckles or the like, similarly to what can be provided for the shoulder straps.

As mentioned, in one alternative embodiment—not shown—the at least one costal connection element 511, 512 is provided to be connected in a fixed or removable manner both to the soft padding 32 and to the rigid frame 31, for example by means of coinciding slots on both of them.

In one embodiment related to the embodiment shown in FIGS. 1 to 4, the vest portions 51, 52 are fastened, each one along the lower edge and for a predetermined length, to the corresponding part of the waist securing belt 4, at the respective joining edges 519 and 529. With the belt 4 in the closed condition at the abdomen, the vest portions 51, 52 are overlapped to the corresponding chest part.

Figure 5:
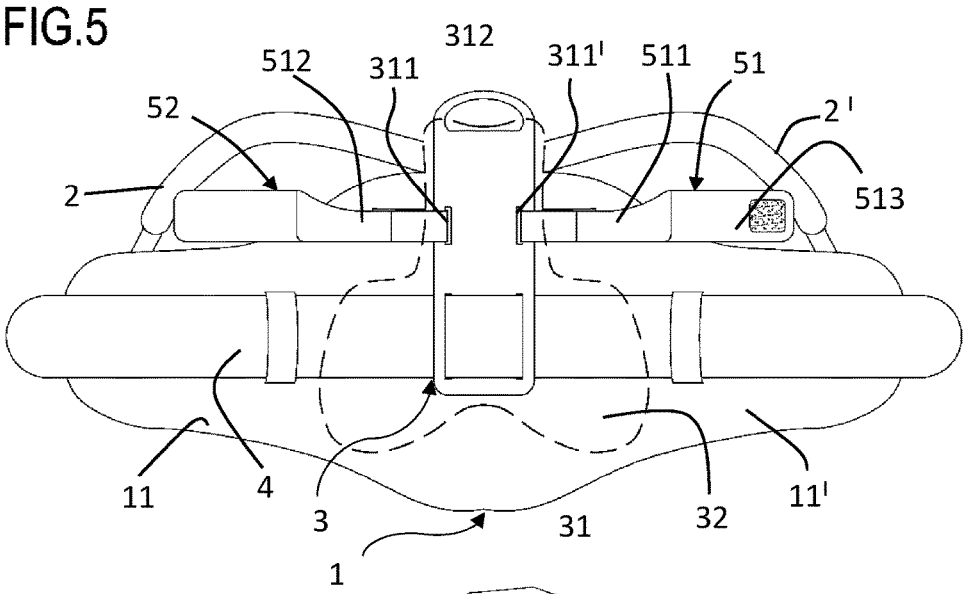
FIG. 5 illustrates a jacket according to the previous figures but configured for male users.
Figure 6:
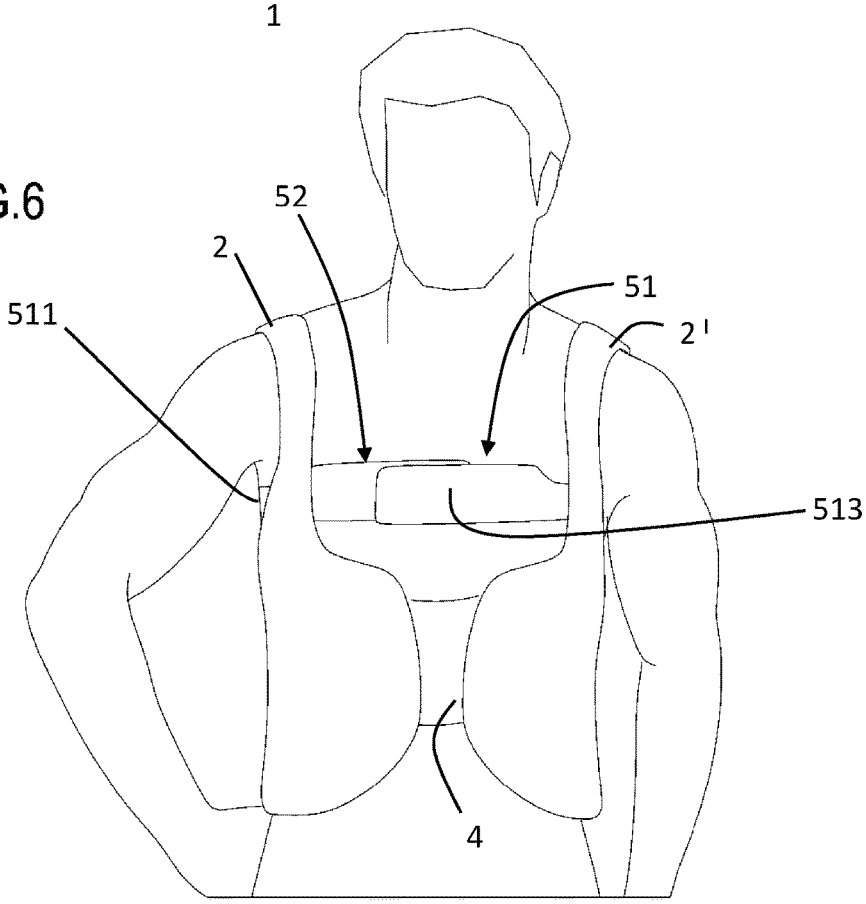
FIG. 6 illustrates the jacket of FIG. 5 in the condition worn by a user.

In another embodiment, shown in FIGS. 5 and 6, the vest portions 51, 52 on the contrary are free at the bottom and, therefore, are not connected to the belt and to other jacket parts.

It should be noted that the vest portions can also have, with respect to the non-limiting enclosed figures, reduced dimensions similarly to the costal connections.

If, as in the illustrated example, the vest portions 51, 52 are separable, they are joinable by at least one joining flap 513 placed on at least one the portions 51, 52 and connectable to the other portion 51, 52.

Figure 7:
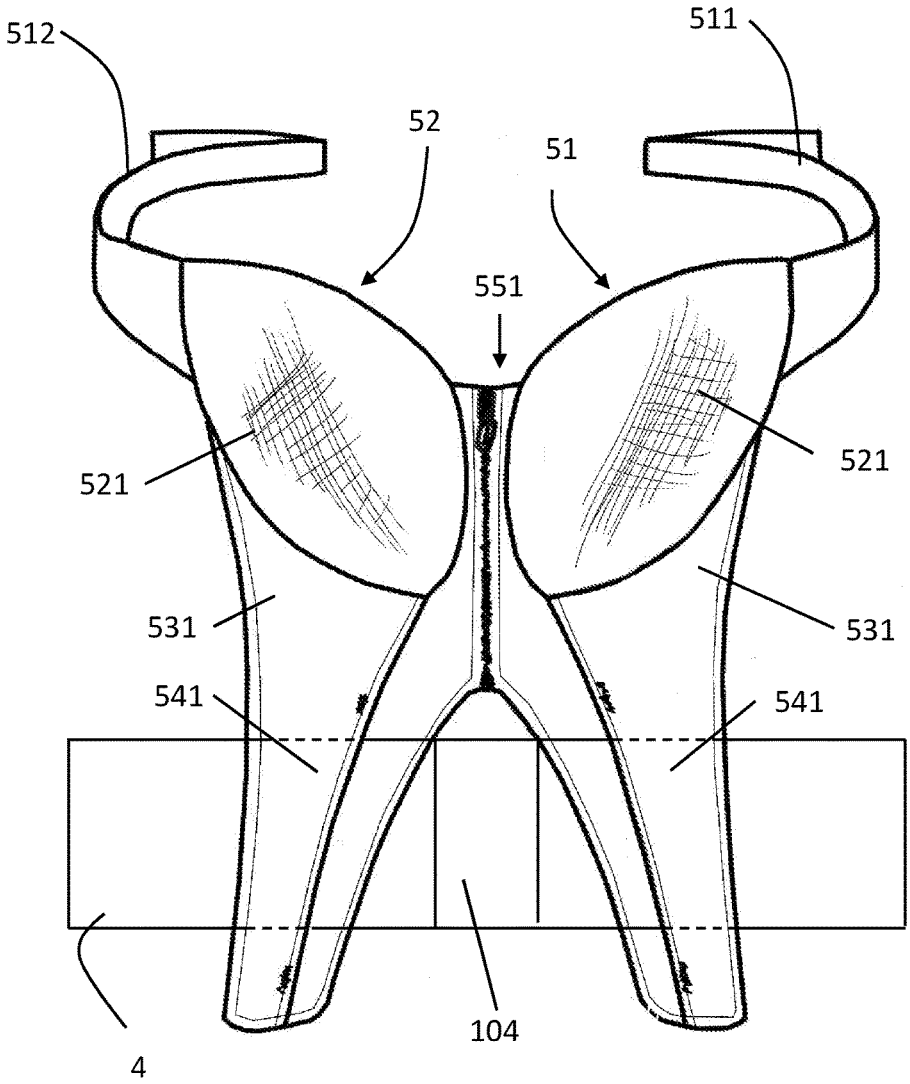
FIG. 7 illustrates a jacket according to the invention, in which the sternal strap is made to be particularly suitable for female users.

As an alternative, the two vest portions can be fastened with each other by a zip fastener as shown in FIG. 7, or even in the variant of FIGS. 8 to 11. Such variant is applicable also to the male version.

The fastening to the waist securing belt 4 can be of the fixed type, for example by means of seams, or of the removable type, for example with a zip-fastener, a hook-and-loop fastener 43, or the like. In an alternative, the flaps can have openings (slots) or a sufficient size for the waist securing strap to pass. Even in this case, such variant is shown only in FIG. 7 with reference to the finale version, but it can be extended also to the male version.

In the embodiment of FIGS. 1 to 4, the waist securing belt 4 is composed of a fabric strip separated from the other parts of the jacket 100, fastened by means of one or more loops 41 to the ventral expansions 11, 11' of the jacket 100.

Preferably vest portions 51, 52 are composed at least partially of elastic fabric for example neoprene.

In a preferred embodiment, each vest portion 51, 52 has a thickened and more rigid edge framing the elastic fabric forming the remaining vest portion 51, 52.

In particular, the costal connection element 511 and 512 or a part thereof and/or the possible part joining each vest portion 51, 52 to the corresponding part of the waist securing belt 4 (if present) may be made of an elastic material to facilitate the wearing of the vest and, therefore, the jacket and the suiting to the torso of the diver, while the joining flap 513 may be made of a different material, for example of a higher thickness to guarantee a better protection, even a thermal protection, on the chest.

The jacket is optionally completed with ballast pockets, inflation valves and vent valves for the gas, at least one over pressure valve, D-rings, clips and the like, all being components known per se in the prior art, and no further reference is made thereto.

Thus, the above objects are achieved, in particular an increased stability when handling cylinder or cylinders in water, when diving and on the ground.

The jacket of the present invention according to FIGS. 1 to 4 is, among other things, particularly suited for women, since it provides for equipment to be safely transported, particularly breathing gas cylinder or cylinders, also out of water without pressing the chest and breast, by the fact that the vest element 5 is not subjected (or only minimally) to the weight of the cylinder.

Moreover, advantageously, straps may not be provided, thus preventing the shoulder straps from opening wide, or—if they are provided—they are prevented from being in direct contact with the body, while providing, even when the wet suit is present, an additional layer protecting against rubbing and abrasions.

Moreover the presence of a sternal securing element according to the invention adds an additional security element to the jacket, since it prevents a jacket from being an excessively inflated, not perfectly adjusted on the diver's torso, or having an excessively large size from slipping upwardly, removing the cylinder.

Several variants to the above described features are possible.

For example, the cylinder or cylinders to be brought may be connected to the jacket, on the hips of the diver and/or, or not only, on the back.

It is also possible to provide, to make easier for the diver to get dressed and undressed and to adapt the jacket to the torso dimensions as much as possible, the upper padded part of each shoulder strap to be provided with a buckle for connecting and tensioning the lower portion of the shoulder strap made as a band and connected, by one end thereof, to one of the inflatable/deflatable ventral expansions 11, 11' of the jacket.

It is also possible to provide the jacket of the present invention not to be of the waistcoat or vest type but to be a jacket called as "technical" or "back inflation", that is composed of a horseshoe bladder or an annular shaped bladder 1 only peripherally fastened to a backplate comprising only the rigid frame 31.

In such variant the shoulder straps 2, 2' and the belt 4 can also be a single piece, that is a single piece of strap passed in suitable slots provided in the backplate 3, thus creating a direct connection between the shoulder straps 2,2' and the rigid frame 31.

Also in this case there is provided the sternal securing element made similarly to the above.

FIGS. 5 and 6 show a variant embodiment of the jacket according to FIGS. 1 to 4 particularly suitable for being used by a man, even if the use is not limited to men.

In this example, the sternal securing element is in the form of a chest or sternal strap 51, 52 made likewise what described for the vest of the example according to FIGS. 1 to 4 and the relevant variants, except for the fact that it has a shape like a belt or strap. Said belt or strap is divided in the front region into two parts removably connectable with each other. Each part of said strap extends along the costal or under-axillary part of the user towards the corresponding side edge of the backplate to which it is connected by end connection elements substantially similar to those described for the embodiment of FIGS. 1 to 4 or the relevant variants.

In the example the two strap parts 51 and 51 are connected with each other by hook-and-loop means or the like.

Said strap parts can be provided, one of them or both of them, with length adjusting means that allow the overall length of the strap to be adjusted to the dimensions of the user such to provide always an action that is sufficient for securing the backplate to the torso area of the user that coinciding with the sternum or chest in order to achieve the functionalities of stabilizing the load composed of the cylinders as described with reference to the preceding example of FIGS. 1 to 4.

With the present invention therefore even a so called "technical" jacket can be provided with a sternal securing element giving the same advantages described above with reference to a jacket made like a waistcoat or vest.

The present invention relates also to a sternal securing element, made as described above, which element can be connected to the backplate 3 and to the waist securing strap 4 of any buoyancy compensator jacket.

As described above the sternal securing element and more particularly the vest element 5 and the costal connection elements 511, 512 and possibly also the lower edge of each vest portion 51, 52 can be provided with means removably connecting with the parts of the jacket, particularly with the backplate part 3 and the waist securing belt 4, such that the sternal securing element can be connected to any vest or jacket (the sternal securing element being not directly connected in any manner to the shoulder straps of the jacket, that bear the cylinder weight) thus enriching it with the advantageous technical characteristics listed above.

With reference to FIG. 7, it shows an embodiment wherein the sternal securing strap takes also a function as a vest suitable for woman torso.

Particularly in the area overlapping the breast, the sternal strap comprises two cups 521 made of a soft material, for example supratex, each for one of the two parts 51 and 52 of the sternal strap. On the side the cups are joined to a respective costal connection element 511, 512 made in this example like previous examples where each costal connection element is separately connected to a slot of the backplate 3.

Likewise the previous examples the costal connection can also be obtained with a single costal connection element connected to the backplate by passing therein, then again extending beyond it towards the front part of the sternal strap wherein the free end is fixed to the other end firmly connected with said sternal strap.

The two sternal strap parts 51, 52 are connected with each other by a zip fastener 551. Such type of connection can be provided also for the sternal strap of the version for man users that has been described above.

Likewise this embodiment can provided as an alternative to the zip fastener 551 also connection means of the Velcro® type or the like.

Moreover also in this embodiment one of the two sternal strap portions 51 or 52 can provide a flap overlapping the zip fastener like the one denoted by 513 of the example of FIGS. 1 to 4.

The embodiment of FIG. 7 further provides each one of the two sternal strap portions 51 and 52 to be connected in the ventral area to the ventral strap or belt 4 by a loop 541. In this case from each sternal strap portion 51, 52 an extension 513 extends downwardly (with reference to the upright position) up to the ventral region the strap 4 passes through. Such extension is shaped such to form a through slit, by means of a cut or by sewing thereon a material bridge forming a through slot as mentioned with 541. The corresponding part of belt 4 is passed through said slit or through slot 541. In the schematic figure the strap is shown as closed by closure means 104.

Such characteristic has not to be considered as limited to the embodiment of FIG. 7 but it can be provided in any combination with the other variants of the embodiments of FIGS. 1 to 6, when not in conflict with them and particularly as an alternative to the connection by sewing the sternal strap portions 51, 52 to the corresponding part of the belt 4.

By this variant, the vest part has functionalities typical of conventional bras, as it has a sternal or costal under-axillary strap securing to the torso and a pair of shoulder strips supporting the chest from the top, without transferring the stress of the shoulder straps to the vest 5 and therefore without generating compressions that make the jacket use uncomfortable or hard.

In the following figures for like parts or parts having same functions as in the embodiment of FIGS. 1 to 4 the same reference numbers are used.

Figure 11:
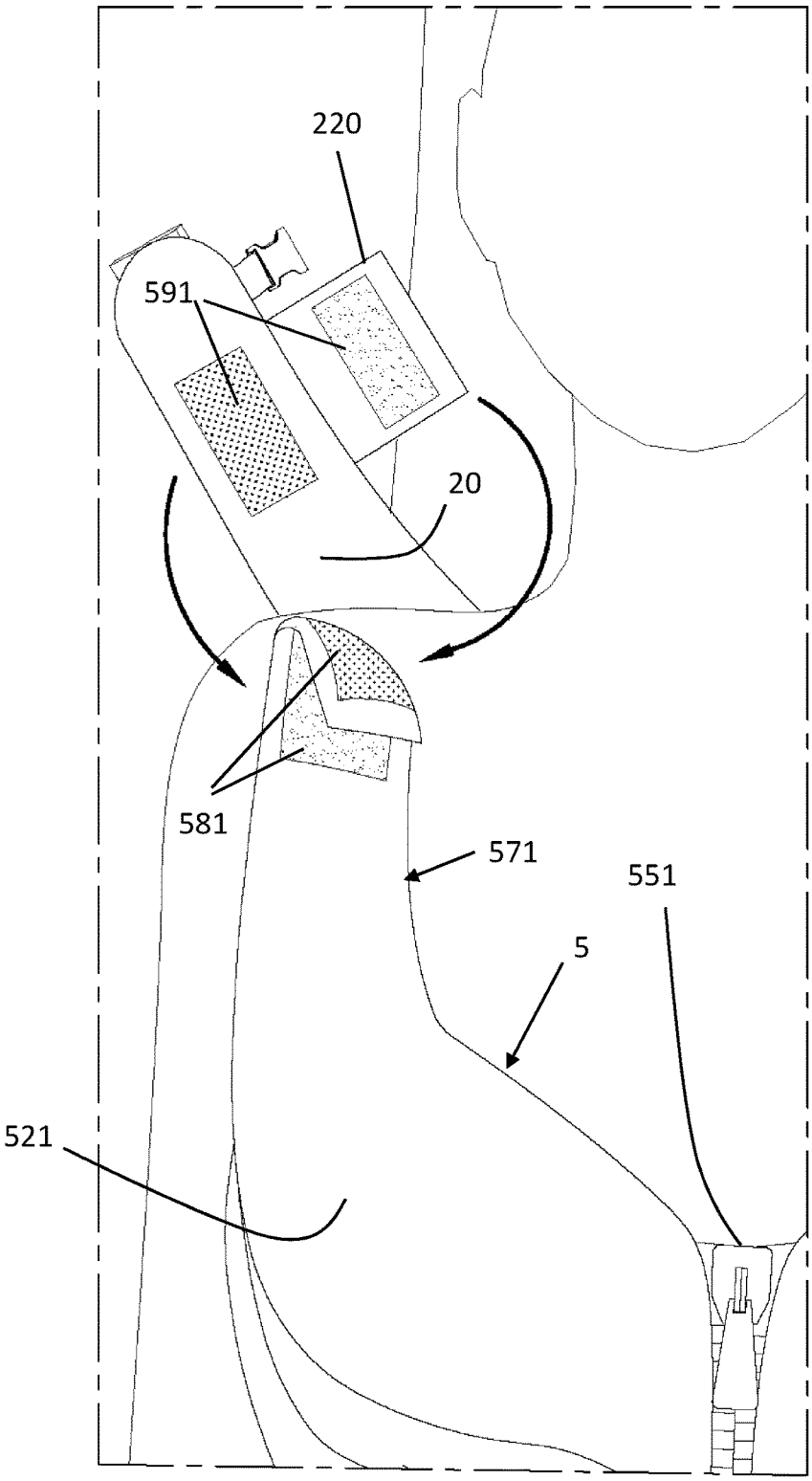
FIG. 11 illustrates an enlargement of the area of the upper extension of the vest or of the sternal strap to the shoulder strap.

As it is particularly clear in FIG. 9 the two vest portions 521 end completely free along their lower edge 561, while as it is clear in FIGS. 10 and 11, each one of the two parts 521 of the vest 5 has an upper shoulder strip extension 571 intended to be connected preferably removably to the corresponding part of the shoulder strap 20, 20'. Each part of shoulder strap 20, 20' in turn is removably connectable to the lower ventral flap 11, 11' of the jacket by means of a snap-on coupling buckle.

Such connection can also provide means for adjusting the length of the shoulder strap each shoulder strap 20, 20' being made in an upper part overlapping the shoulder and ending at the front thereof and a lower part firmly connected to the corresponding lower flap 11, 11' of the jacket. The two parts of the shoulder strap are connected by a buckle 320 and one of such parts is provided with a length adjusting device as the one denoted by 520, that is adjusting the position of the corresponding part of said buckle along the extension of said shoulder strap part, that is of the strap 420 according to embodiments of FIGS. 8 to 11. In this embodiment such shoulder strap part is composed of a belt or a ribbon or strap 420 that by one end is firmly connected to the corresponding lower part 11 of the jacket, while the other carries the buckle part cooperating with the complementary buckle part associated to the upper segment of the shoulder strap 20, 20' and that forms the snap-on removable connection buckle 320.

The upper shoulder strip extension 571 of each vest portion 521 can be connected in any known manner to the corresponding shoulder strap 20, 20' and preferably it is connected to the upper part thereof in a separable manner by means for example of fastening devices of the type known as "hook-and-loop fasteners" or under the trademark Velcro) or the like. In the shown embodiment of FIGS. 8 to 11, and particularly in FIGS. 10 and 11, the upper shoulder strip extension 571 has said fastening device 581 on its two faces one of such device being intended to cooperate with the corresponding complementary part 591 fastened on the rear side of the shoulder strap 20, 20', while the other one of said devices 581 is intended to cooperate with a complementary device 591 provided on a side tab 220 of the shoulder strap which is folded on the face of the upper shoulder strip extension 571 that remains free in the condition coupled with the corresponding part of the shoulder strap 20, 20'.

Likewise what described for the fastening means of the costal elements also in this case different types of fastening devices can be possible and the fastening of the upper shoulder strip extension 571 to the corresponding part of the shoulder strap 20, 20' can be removable or fixed as described above.

It is clear from what disclosed above that the static and mechanical stress on the shoulder straps 20, 20' is transmitted to the ventral strap and/or to the two lower flaps 11, 11' of the jacket. As regards the vest 5, since it is completely free from structural parts of the jacket along the lower edge, the two upper shoulder strip extensions 571 do not act as elements on which forces exerted by the load on the shoulder straps are transmitted, but they are only elements for the support at the top and towards the top of the vest that reproduces in this last one the typical shape of the woman bra, without transmitting essentially compression stresses on the chest other than those generated by the vest itself. This increases the comfort of woman jacket since it combines not only the effect of better securing the jacket against swinging motion, but it protects the chest and it supports it in a natural manner and in a manner corresponding to usual conditions of everyday life.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become obvious to those skilled in the art and the scope of the present invention is limited only by the appended claims.

The invention claimed is:

1. A buoyancy compensator jacket for scuba diving comprising:

an inflatable and deflatable bladder (1);

a backplate part (3), to which the bladder (1) and elements fastening at least one breathing gas cylinder are directly or indirectly attached;

at least one pair of shoulder straps (2, 2'; 20, 20') securing the buoyancy compensator jacket to a torso of a user;

at least one ventral securing strap (4) and/or ventral closure (843, 943, 1043) of the buoyancy compensator jacket; and a sternal securing element comprising at least one sternal strap (5), the sternal or chest strap having at least one costal connection element (511, 512) distinct from the pair of shoulder straps (2, 2'; 20, 20') and decoupled from the bladder, the at least one costal connection element (511, 512) connecting the sternal strap (5) to the backplate part (3).

2. The buoyancy compensator jacket according to claim 1, wherein the shoulder straps (2, 2'; 20, 20') are directly coupled to the backplate part (3).

3. The buoyancy compensator jacket according to claim 1, wherein the shoulder straps (2, 2'; 20, 20') are indirectly coupled to the backplate part (3) with or by being one piece with the bladder (1), the bladder (1) being coupled to the backplate (3).

4. The buoyancy compensator jacket according to claim 1, wherein the sternal securing element (5) is dividable into two portions, a right portion (51) and a left one (52), the two portions being connectable to each other substantially at a median longitudinal band of the chest, each portion of said sternal securing element (51', 52') being connected by its own costal connection element (511, 512) to a corresponding side of the backplate (3).

5. The buoyancy compensator jacket according to claim 4, wherein each portion (51, 52) of the sternal securing strap (5) is further connected to a corresponding shoulder strap.

6. The buoyancy compensator jacket according to claim 5, wherein each portion (51,52) of the sternal securing strap (5) has an upper shoulder strip extension (571) having an end is connected to the shoulder strap (20,20').

7. The buoyancy compensator jacket according to claim 4, wherein the portions (51, 52) of the sternal securing element form a vest element, and wherein the portions (51, 52) of the sternal securing element overlap a corresponding chest part covering at least a breast and part of a sternal band, and wherein areas of said portions (51, 52) overlapping the breast have cups shapes.

8. The buoyancy compensator jacket according to claim 1, wherein the sternal securing element (5) comprises a single costal connection element, passing through at least one loop of the backplate (3) and extending towards a sternal area, said costal connection element being provided with two ends mutually fastening in different tensile conditions of the sternal securing element.

9. The buoyancy compensator jacket according to claim 1, wherein at least one costal connection element (511, 512) is connectable to the backplate part (3) in a position not coinciding with the position of the pair of shoulder straps (2, 2'; 20, 20').

10. The buoyancy compensator jacket according to claim 1, wherein the at least one costal connection element (511, 512) is separated from a corresponding shoulder strap (2,2').

11. The buoyancy compensator jacket according to claim 1, wherein the sternal securing element (5) is adapted to be fastened along at least a part of its lower edge (519) to a part of ventral securing belt (4) or to a jacket part coinciding with, containing, or composing lower side bladders (11, 11').

12. The buoyancy compensator jacket according to claim 1, wherein a lower edge of the sternal securing element is completely separated from the jacket.

13. The buoyancy compensator jacket according to claim 1, further comprising a waist securing strap (4) directly or indirectly coupled to the backplate part (3) in locations different than locations fastening the sternal securing element to said backplate (3), the waist securing strap (4) having ends (41, 42) connectable to each other at an abdomen with removable closure elements (43).

14. The buoyancy compensator jacket to claim 1, wherein the backplate part 3 comprises a rigid frame (31) having at least two through slots (311, 311') for passage and connection in each through slot of a free end of each costal connection element, said free end of each costal connection element passing in said slot (311, 311') being folded on itself to form a slotted extension or for generating a loop for a single costal connection element.

15. The buoyancy compensator jacket according to claim 14, wherein said free end of each connection element (511, 512) is length-adjustable, two mutually contacting portions of a same connection element being removably coupled to each other and lockable in several positions with respect to their longitudinal extensions.

16. The buoyancy compensator jacket according to claim 1, wherein at least one portion of the sternal securing element (51, 52) comprises a joining flap (513) at a median longitudinal band of a chest, configured to connect another portion of said sternal securing element.

17. A buoyancy compensator jacket for scuba diving comprising:

an inflatable and deflatable bladder (1);

a backplate part (3), to which the bladder (1) and elements fastening at least one breathing gas cylinder are directly or indirectly attached;

at least one pair of shoulder straps (2, 2'; 20, 20') securing the buoyancy compensator jacket to a torso of a user;

at least one ventral securing strap (4) and/or ventral closure (843, 943, 1043) of the buoyancy compensator jacket;

a sternal securing element comprising at least one sternal strap (5), the sternal or chest strap having at least one costal connection element (511, 512) distinct from the pair of shoulder straps (2, 2'; 20, 20') and connecting the sternal strap (5) to the backplate part (3); and a waist securing strap (4) coupled to the backplate part (3) in locations different than locations fastening the sternal securing element to said backplate (3), the waist securing strap (4) having ends (41, 42) connectable to each other at an abdomen with removable closure elements (43), wherein the pair of shoulder straps (2, 2'; 20, 20') is coupled to the backplate part (3) at a first upper terminal end, the waist securing belt (4) is coupled to the backplate part (3) at a second lower terminal end of the backplate with reference to a wearing condition on a person in an upright position, and the costal connection elements (511, 512) are connectable to the backplate part (3) in a hooking position on the backplate part (3) extending between first and the second terminal ends.

18. A sternal closure element comprising:

a sternal strap or a vest (5) connectable to a buoyancy compensator jacket (100) having a bladder, the sternal strap or a vest (5) being configured to surround a diver's chest when the buoyancy compensator jacket is worn, wherein the sternal strap or vest (5) is connected fixedly or removably to a backplate part (3) of said buoyancy compensator jacket (100) by one or more costal connection elements (511, 512) each coupled to each end of said sternal strap or of said vest (5), and wherein one or more costal connection elements is or are separated from shoulders straps (2, 2'; 20, 20') and decoupled from the bladder of the buoyancy compensator jacket and connect independently the shoulder straps to the backplate (31).

19. The sternal closure element according to claim 18, further comprising fastening elements removably or separably fastening the buoyancy compensator jacket (100), the fastening elements being separate from or coupled to said jacket.

* * * * *